US009466886B2

(12) United States Patent
Kashino et al.

(10) Patent No.: US 9,466,886 B2
(45) Date of Patent: Oct. 11, 2016

(54) ANTENNA DEVICE

(71) Applicant: Panasonic Corporation, Osaka (JP)

(72) Inventors: Yuichi Kashino, Ishikawa (JP); Hiroyuki Uno, Ishikawa (JP); Suguru Fujita, Tokyo (JP); Ryosuke Shiozaki, Kanagawa (JP); Kentaro Watanabe, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 3 days.

(21) Appl. No.: 14/381,061

(22) PCT Filed: Dec. 25, 2013

(86) PCT No.: PCT/JP2013/007599

§ 371 (c)(1),
(2) Date: Aug. 26, 2014

(87) PCT Pub. No.: WO2014/103311

PCT Pub. Date: Jul. 3, 2014

(65) Prior Publication Data

US 2015/0002353 A1 Jan. 1, 2015

(30) Foreign Application Priority Data

Dec. 28, 2012 (JP) ..... 2012-289071

(51) Int. Cl.
*H01Q 13/10* (2006.01)
*H01Q 19/22* (2006.01)
(Continued)

(52) U.S. Cl.
CPC ..... *H01Q 13/106* (2013.01); *H01Q 13/10* (2013.01); *H01Q 19/22* (2013.01); *H01Q 19/28* (2013.01); *H01Q 1/22* (2013.01); *H01Q 1/2291* (2013.01); *H01Q 21/28* (2013.01)

(58) Field of Classification Search
None
See application file for complete search history.

(56) References Cited

U.S. PATENT DOCUMENTS 6,342,864 B1 * 1/2002 Muramoto ..... H01Q 13/106 343/700 MS
2005/0162328 A1 * 7/2005 Mori ..... H01Q 3/44 343/770

(Continued)

FOREIGN PATENT DOCUMENTS

JP 2001-094340 A 4/2001
JP 2005-210520 A 8/2005

(Continued)

OTHER PUBLICATIONS

International Search Report for Application No. PCT/JP2013/007599 dated Mar. 25, 2014.

(Continued)

*Primary Examiner* — Robert Karacsony
(74) *Attorney, Agent, or Firm* — Pearne & Gordon LLP

(57) ABSTRACT

There is provided an antenna device which can suitably tilt directivity of an antenna. The antenna device includes a dielectric substrate, a conductive plate arranged on one surface of the dielectric substrate, a first slot element to which electric power is supplied from a power supply line, which has an electrical length having an approximately ½ wavelength of use frequency of the antenna device, and which is formed in the conductive plate, a second slot element which has an electrical length longer than that of the first slot element, and which is formed in the conductive plate to be substantially parallel to the first slot element by leaving a gap of an approximately ¼ wavelength of the electrical length from the first slot element, and a ground conductor arranged to be substantially parallel to the conductive plate by leaving a predetermined gap from the conductive plate.

12 Claims, 16 Drawing Sheets

(51) Int. Cl.

| | |
|---|---|
| ***H01Q 19/28*** | (2006.01) |
| *H01Q 1/22* | (2006.01) |
| *H01Q 21/28* | (2006.01) |

(56) References Cited

U.S. PATENT DOCUMENTS

| | | | | |
|---|---|---|---|---|
| 2007/0216594 | A1 | 9/2007 | Uno et al. | |
| 2014/0145883 | A1* | 5/2014 | Baks | H01Q 1/2283 343/700 MS |

FOREIGN PATENT DOCUMENTS

| | | |
|---|---|---|
| JP | 2007-081246 A | 3/2007 |
| JP | 2010-050700 | 3/2010 |
| JP | 2010-103871 A | 5/2010 |

OTHER PUBLICATIONS

Chinese Search Report for Application No. 201380011163.3 dated Jun. 23, 2016.

* cited by examiner (A)

VERTICALLY POLARIZED WAVE Eθ COMPONENT (B)

VERTICALLY POLARIZED WAVE Eθ COMPONENT (A)

VERTICALLY POLARIZED WAVE Eθ COMPONENT (B)

VERTICALLY POLARIZED WAVE Eφ COMPONENT

ANTENNA DEVICE

TECHNICAL FIELD

The present disclosure relates to an antenna device.

BACKGROUND ART

As an antenna device in the related art, a slot antenna illustrated in FIGS. 14(A) to 14(C) is known (for example, refer to Patent Literature 1). FIGS. 14(A) to 14(C) are perspective views illustrating a dielectric substrate, a conductive layer, and a reflection plate in the slot antenna in the related art.

The slot antenna has a microstrip line 202 on a front surface of a dielectric substrate 201, and a conductive layer 203 is arranged on a rear surface of the dielectric substrate 201. In addition, a plurality of slots 204*a* to 204*d* is formed in the conductive layer 203. The plurality of slots 204*a* to 204*d* receives electric power via the microstrip line 202, thereby realizing emission in a horizontal direction (−X direction) of the dielectric substrate 201. In addition, a cavity-formed reflection plate 205 in which a raising-processed portion 206 is disposed is arranged in the plurality of slots 204*a* to 204*d*, thereby achieving antenna performance excellent in a front back ratio (FB ratio).

CITATION LIST

Patent Literature

Patent Literature 1: JP-A-2001-094340

SUMMARY OF INVENTION

Technical Problem

The technology disclosed in Patent Literature 1 has a difficulty in tilting directivity of an antenna from a horizontal direction.

The present disclosure is made in view of the above circumstances, and provides an antenna device which can suitably tilt the directivity of the antenna.

Solution to Problem

An antenna device according to the present disclosure includes: a dielectric substrate; a conductive plate which is arranged on one surface of the dielectric substrate; a first slot element to which electric power is supplied from a power supply line, wherein the first slot element has an electrical length having an approximately ½ wavelength of use frequency, and is formed in the conductive plate; a second slot element which has an electrical length longer than that of the first slot element, and which is formed in the conductive plate to be substantially parallel to the first slot element by leaving a gap of an approximately ¼ wavelength of the electrical length from the first slot element; and a ground conductor which is arranged to be substantially parallel to the conductive plate by leaving a predetermined gap from the conductive plate.

Advantageous Effects of Invention

According to the present disclosure, it is possible to suitably tilt directivity of an antenna.

DESCRIPTION OF EMBODIMENTS

Hereinafter, an embodiment of the present disclosure will be described with reference to the drawings.

(Background of Embodiment of Present Disclosure)

Figure 15:
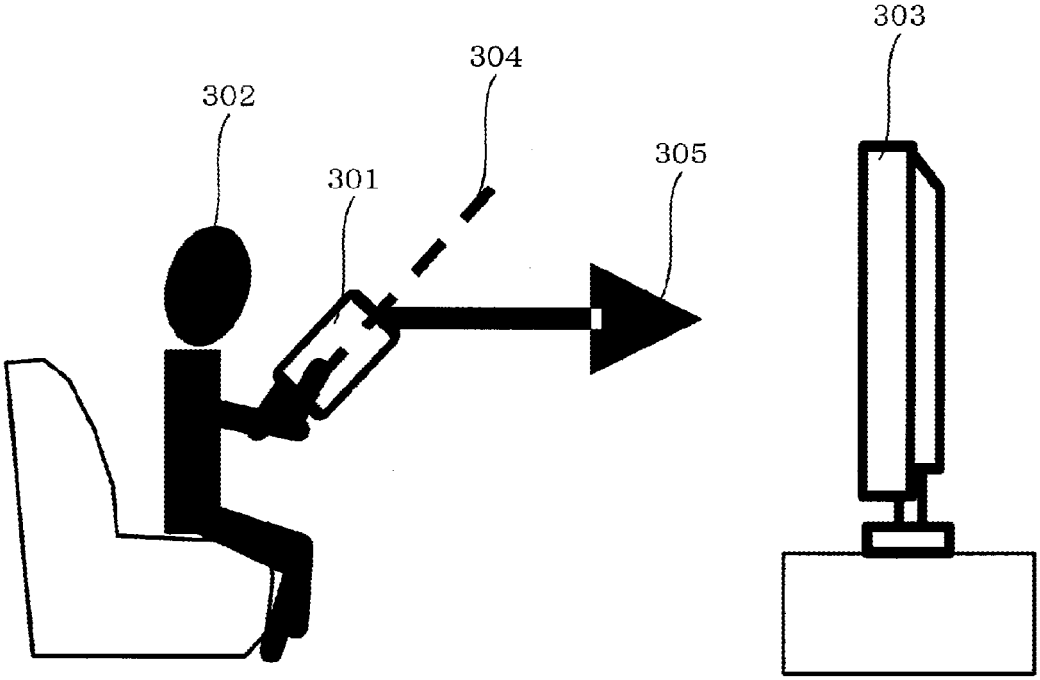
FIG. 15 is a schematic view illustrating an example of a use case which is assumed when an antenna device is mounted on a mobile terminal.

When an antenna device is mounted on a mobile terminal, a use case illustrated in FIG. 15 is assumed, for example. In FIG. 15, a user 302 gripping a mobile terminal 301 transmits a control signal to a television apparatus 303, for example, by using the mobile terminal. In this case, if directivity is arranged in a direction 305 tilted (inclined) from a substrate surface direction 304 (direction parallel to a substrate surface) inside the mobile terminal at a predetermined angle, the user feels improved convenience.

In the following embodiment, the antenna device which can suitably tilt the directivity of an antenna will be described.

Embodiment

For example, the antenna device according to the present embodiment is used in a wireless communication circuit of high-frequency (for example, 60 GHz) in a millimeter-wave band. Various electronic components (for example, the antenna and a semiconductor chip) are mounted on the antenna device. For example, the antenna device is operated as a slot antenna.

Figure 1:
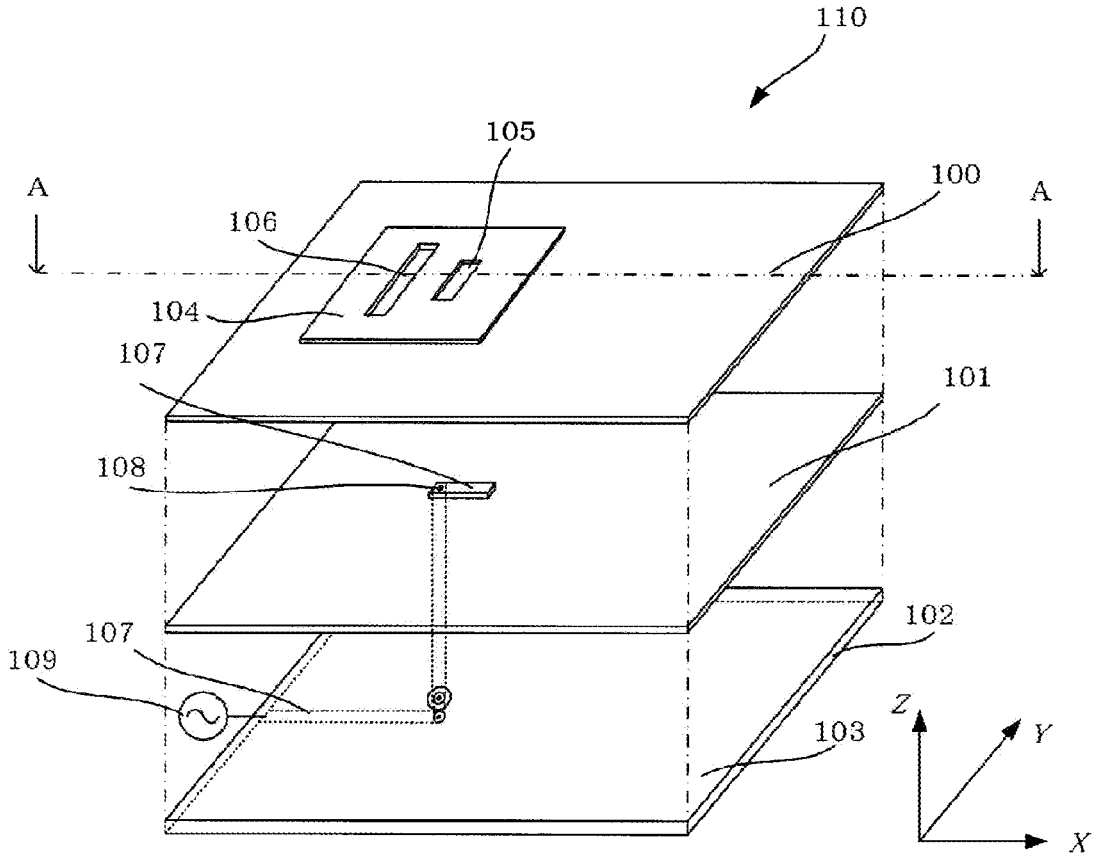
FIG. 1 is an exploded perspective view illustrating a structure example of an antenna device according to an embodiment.
Figure 2:
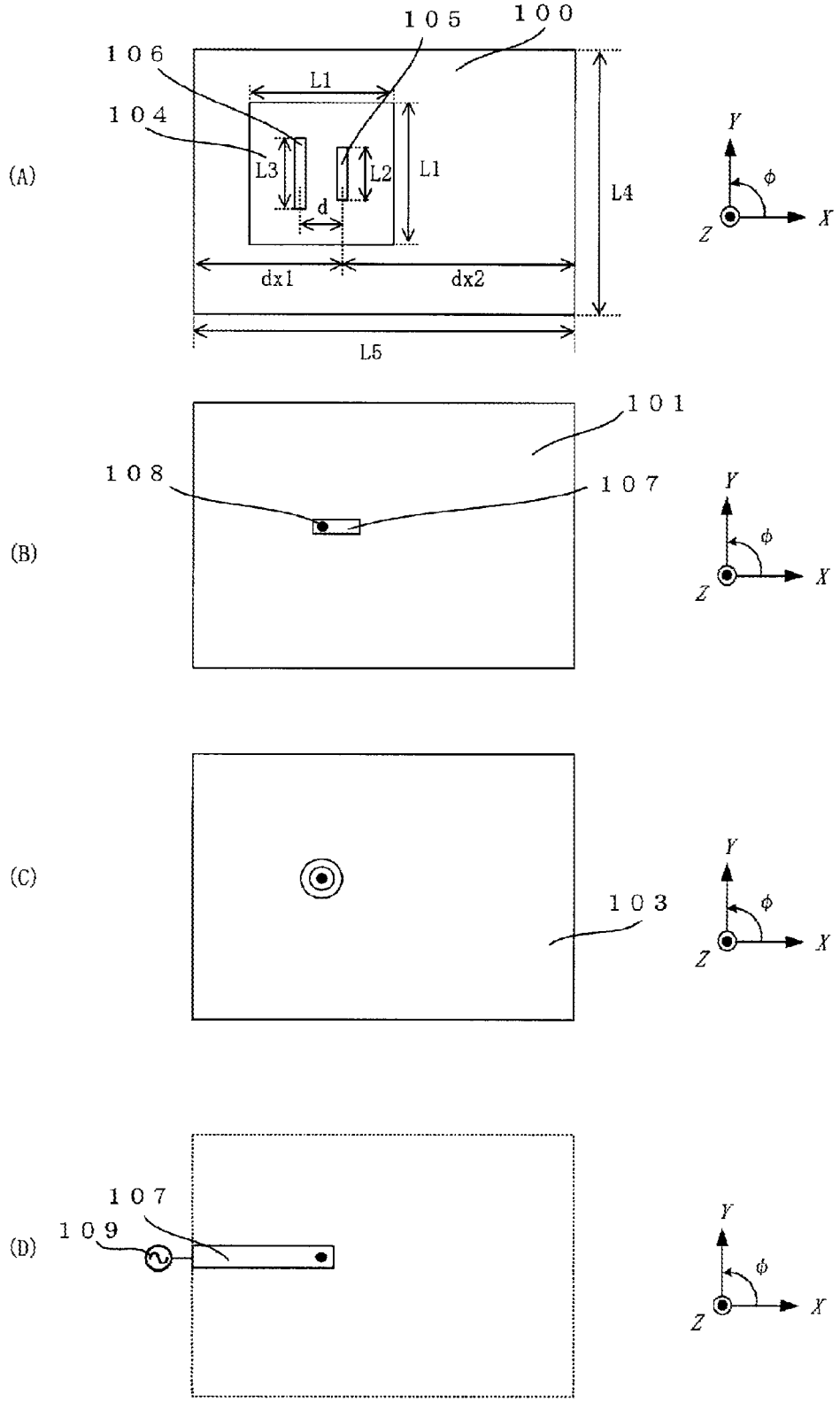
In FIG. 2, (A) to (D) are plan views illustrating a pattern configuration example in each layer of a multilayer substrate according to an embodiment.
Figure 3:
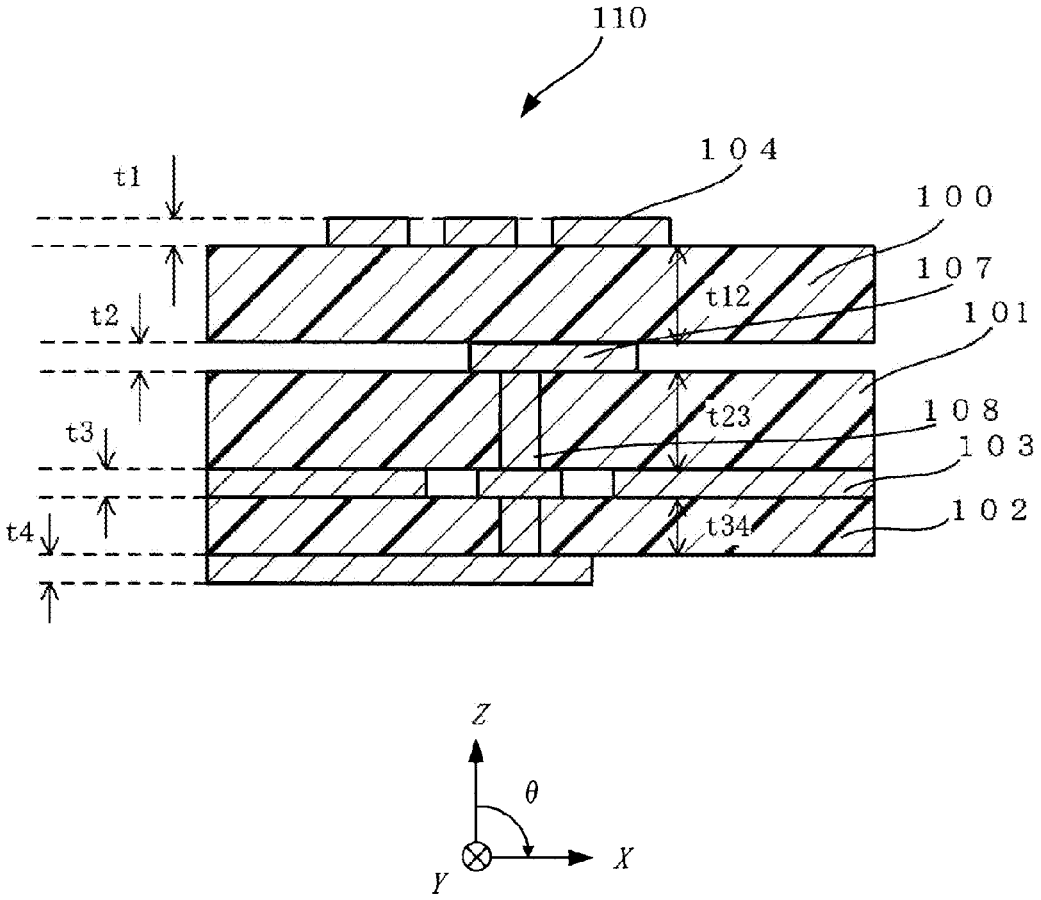
FIG. 3 is a cross-sectional view taken along line A-A which illustrates a structure example of an antenna device according to an embodiment.

FIG. 1 is an exploded perspective view illustrating a configuration example of an antenna device 110 according to the embodiment. FIGS. 2(A) to 2(D) are plan views illustrating a pattern configuration example in each layer of the antenna device 110. FIG. 3 is a cross-sectional view taken along line A-A which illustrates the configuration example of the antenna device 110 illustrated in FIG. 1. FIG. 3 illustrates a state in which each substrate is combined with one another.

The antenna device 110 includes a first dielectric substrate 100, a second dielectric substrate 101, a third dielectric substrate 102, a ground conductor 103, a pattern 104, an emission element 105, a reflection element 106, and a power supply line 107. That is, the antenna device 110 has a multilayer substrate. In addition, the pattern 104 has a substantially square shape in a plan view, for example. The pattern 104 is configured to have a metallic conductor (for example, a copper foil).

The first dielectric substrate 100, the second dielectric substrate 101, and the third dielectric substrate 102 are substrates having relative dielectric constant $\in r$ (for example, 3.6). In addition, the first dielectric substrate 100, the second dielectric substrate 101, and the third dielectric substrate 102 are arranged to be substantially parallel to each other.

In FIG. 1, a thickness of the first dielectric substrate 100 is t12 (for example, 0.02λ). A thickness of the second dielectric substrate is t23 (for example, 0.03λ). A thickness of the third dielectric substrate is t34 (for example, 0.02λ). "λ" indicates a free space wavelength corresponding to use frequency of the antenna device 110.

In the present embodiment, one surface side (+Z side) of the first dielectric substrate 100 is referred to as a first layer (L1 layer), and one surface side (+Z side) of the second dielectric substrate 101 is referred to as a second layer (L2 layer). In addition, one surface side (+Z side) of the third dielectric substrate 102 is referred to as a third layer (L3 layer), and the other surface side (−Z side) of the third dielectric substrate 102 is referred to as a fourth layer (L4 layer).

In FIG. 1, the thickness of a copper foil pattern formed on the L1 layer is t1. In addition, the thickness of a copper foil pattern formed on the L2 layer is t2. In addition, the thickness of a copper foil pattern formed on the L3 layer is t3. In addition, the thickness of a copper foil pattern formed on the L4 layer is t4. The thicknesses t1 to t4 of the copper foil patterns are 0.004λ, for example.

In the L1 layer, for example, a substantially square-shaped pattern 104 formed by the copper foil pattern is arranged on one surface side (+Z side) of the first dielectric substrate 100. The emission element 105 and the reflection element 106 which are formed by cutting out a portion of the pattern 104 in a slot shape are disposed in the pattern 104. The emission element 105 is an example of a first slot element. The reflection element 106 is an example of a second slot element.

The emission element 105 and the reflection element 106 are arranged to be substantially parallel to each other in the L1 layer. In addition, the reflection element 106 is longer than the emission element 105 in a longitudinal direction (Y direction in FIG. 1). The reflection element 106 is arranged on a side opposite to (−X side in FIG. 1) a desired antenna emission direction (direction having the directivity) as compared to the emission element 105. In this manner, the slot antenna is formed by a conductor pattern on the dielectric substrate.

The emission element 105 is operated as an emitter for emitting radio waves. Accordingly, a slot length (length in the longitudinal direction of the emission element 105 in FIG. 1) L2 is set to be substantially ½ λg. The "λg" indicates a wavelength which corresponds to the use frequency of the antenna device 110 and is obtained by considering a wavelength shortening effect inside the substrate.

The reflection element 106 is operated as a reflector. Accordingly, a distance d between the emission element 105 and the reflection element 106 is set to be substantially ¼ λg. It is possible to tilt the directivity of the antenna from the horizontal direction (XY direction) or the vertical direction (Z direction) of the substrate by setting the distance d to be substantially ¼ λg. In addition, a slot length L3 of the reflection element 106 (length in the longitudinal direction of the reflection element 106 in FIG. 1) is set to be longer than a slot length L2 of the emission element 105, and is set to be shorter than a length L1 of one side of the substantially square-shaped pattern 104 which is parallel to the emission element 104.

The length from the emission element 105 to an end side of the reflection element 106 side (−X side) in the first dielectric substrate 100 is dx1 (for example, 1.15 λg). The length from the emission element 105 to an end side in an emission direction (+X side) in the first dielectric substrate 100 is dx2 (for example, 2.89 λg).

In the L2 layer, the power supply line 107 is disposed on one surface side (+Z side) of the second dielectric substrate 101. The power supply line 107 is arranged at a position substantially orthogonal to the emission element 105 in a plan view of the XY plane so as to be electromagnetically coupled to the emission element 105.

In addition, the power supply line 107 extends to the L4 layer via a through-hole 108 formed from the L2 layer to the L3 layer, and is connected to a power supply section 109. The power supply section 109 is arranged in an external substrate (for example, a mother board) which is not illustrated, for example.

As described above, the emission element 105 is a power supply element, and the reflection element 106 is a passive element. Accordingly, the power supply line 107 does not need to supply the electric power to a plurality of emission elements, but requires only the length which enables the power supply to the emission element 105. Therefore, it is possible to shorten the length of the power supply line 107 in the L2 layer, and thus, it is possible to suppress a signal loss caused by the power supply line 107.

In the L3 layer, the ground conductor 103 is arranged on one surface side (+Z side) of the third dielectric substrate 102. The ground conductor 103 is arranged to be substantially parallel to the pattern 104 arranged in the first dielectric substrate 100.

In the L4 layer, an electronic component may be mounted on the other surface side (−Z side) of the third dielectric substrate 102. When the electronic component (for example, a semiconductor chip) is mounted on the L4 layer, the ground conductor 103 is arranged between the electronic component and the emission element 105 serving as the antenna or the reflection element 106. This can prevent the electronic component side as well as the antenna side from electrically interfering with each other, thereby improving reliability of the antenna device 110.

The other surface side (−Z side) of the third dielectric substrate 102 is an example of the other surface of the second dielectric substrate on which the electronic component is mounted.

Next, an analysis example of an antenna emission pattern of the antenna device 110 will be described.

Figure 4:
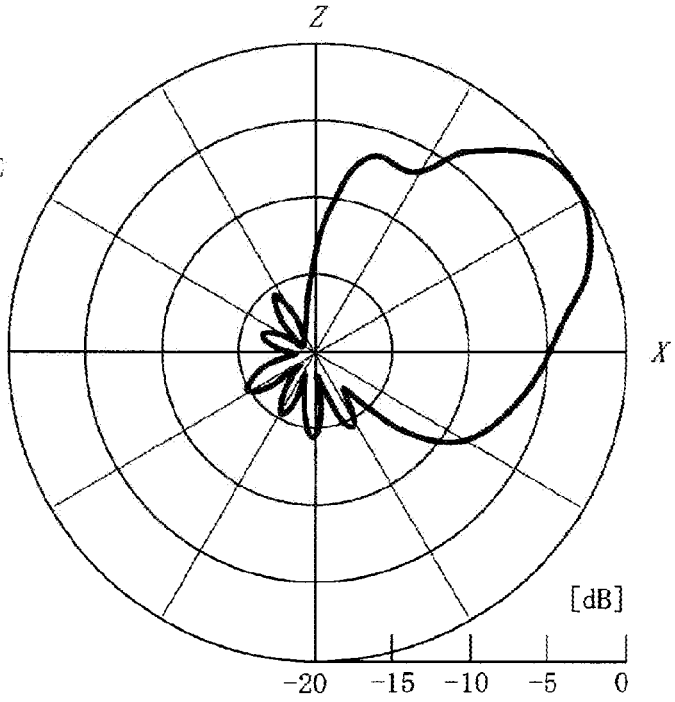
In FIG. 4, (A) is a schematic view illustrating an example of an analysis result (directivity on a vertical (XZ) surface) of an antenna emission pattern according to an embodiment, and (B) is a schematic view illustrating an example of an analysis result (directivity on a conical surface (θ=58 degrees)) of an antenna emission pattern according to an embodiment.
Figure 4:
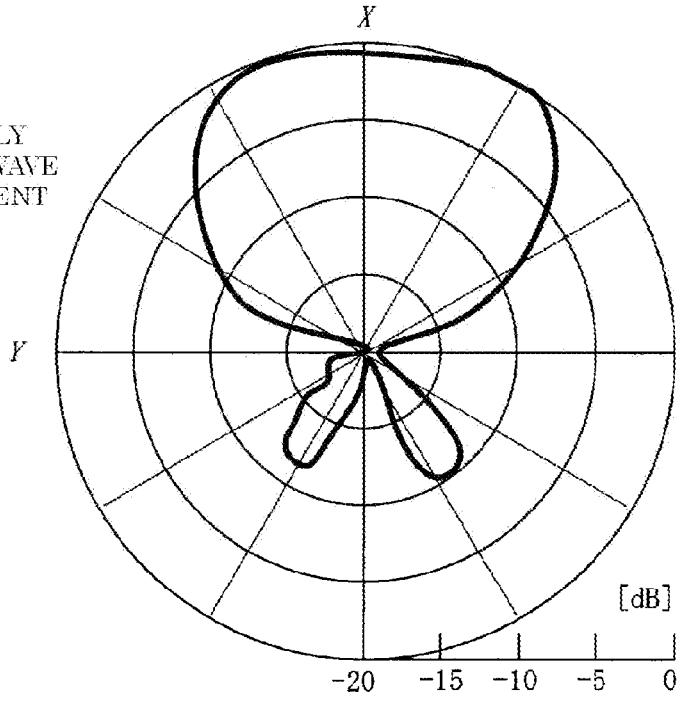

FIGS. 4(A) and 4(B) are schematic views illustrating an example of an analysis result of the antenna emission pattern analyzed by the finite integral method when the antenna device 110 is designed to have dimensions which are described above as an example. The emission pattern illustrated in FIGS. 4(A) and 4(B) is described as the emission pattern of a polarized wave (Eθ component) in the vertical direction to the substrate which is a main polarized wave.

FIG. 4(A) illustrates an emission pattern indicating the directivity of a substrate vertical surface (XZ surface). Referring to FIG. 4(A), when a +Z direction is set to have an elevation angle (tilting angle) of θ=0 degrees, the result is θ=58 degrees approximately. Accordingly, it can be confirmed that the +Z direction is tilted to a substrate horizontal direction (XY direction).

Figure 13:
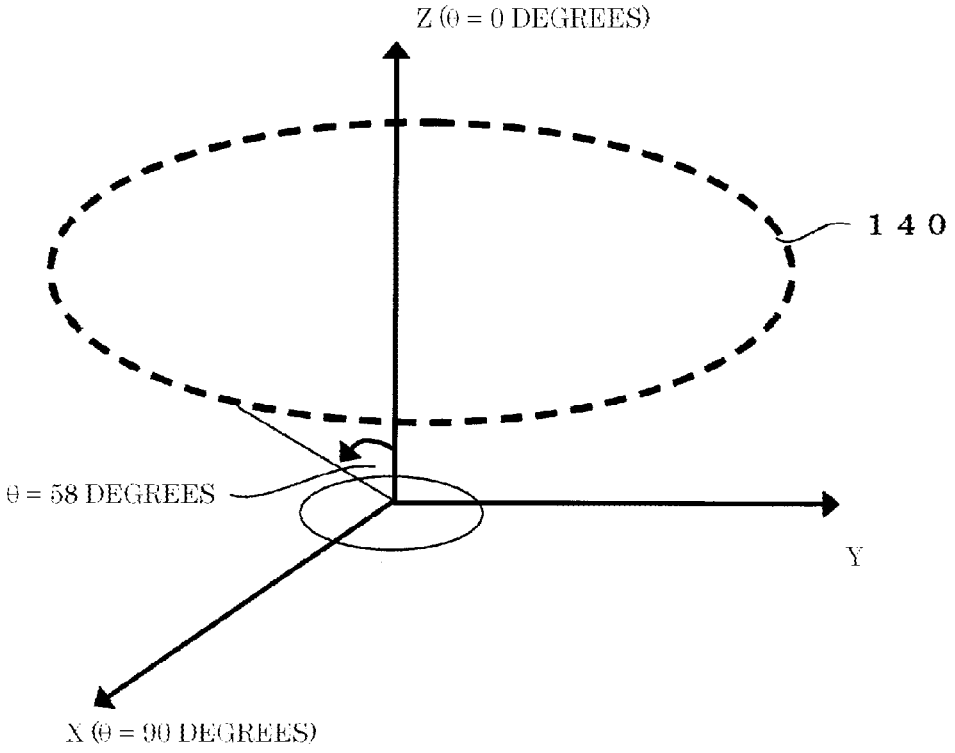
FIG. 13 is a schematic view for explaining directivity on a conical surface according to an embodiment.

In addition, FIG. 4(B) illustrates an emission pattern indicating the directivity of a conical surface. As illustrated in FIG. 13, the directivity of the conical surface indicates the directivity on a surface 140 which is parallel to the substrate horizontal direction (XY direction) in a beam tilting direction (θ=58 degrees). Referring to FIG. 4(B), it can be confirmed that the radio wave emitted from the emission element 105 mainly has a component of a +X direction in the substrate horizontal direction (XY direction).

Next, an example of a change in antenna performance when the length L1 is changed will be described.

Figure 5:
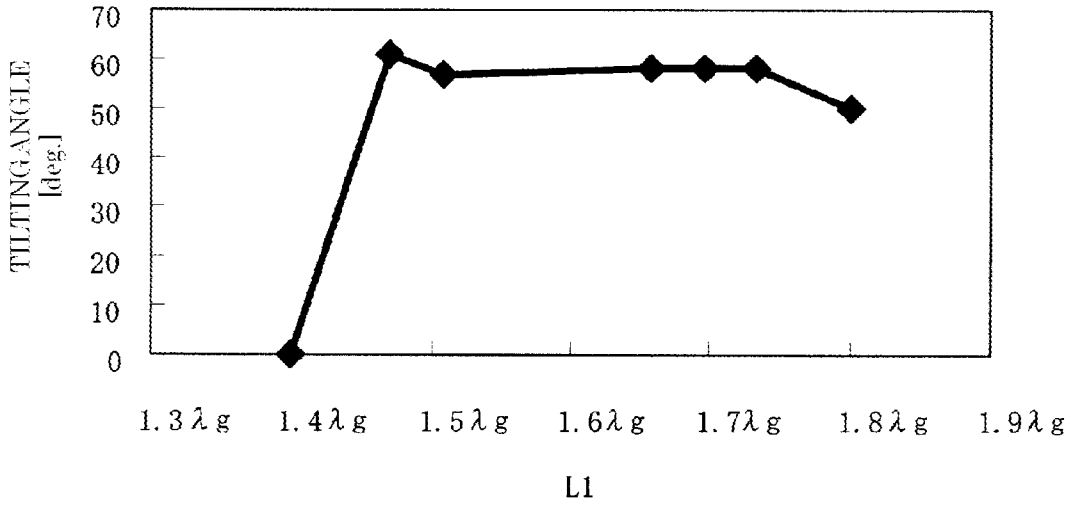
FIG. 5 is a schematic view illustrating an example of a relationship between a length L1 and a tilting angle θ according to an embodiment.
Figure 6:
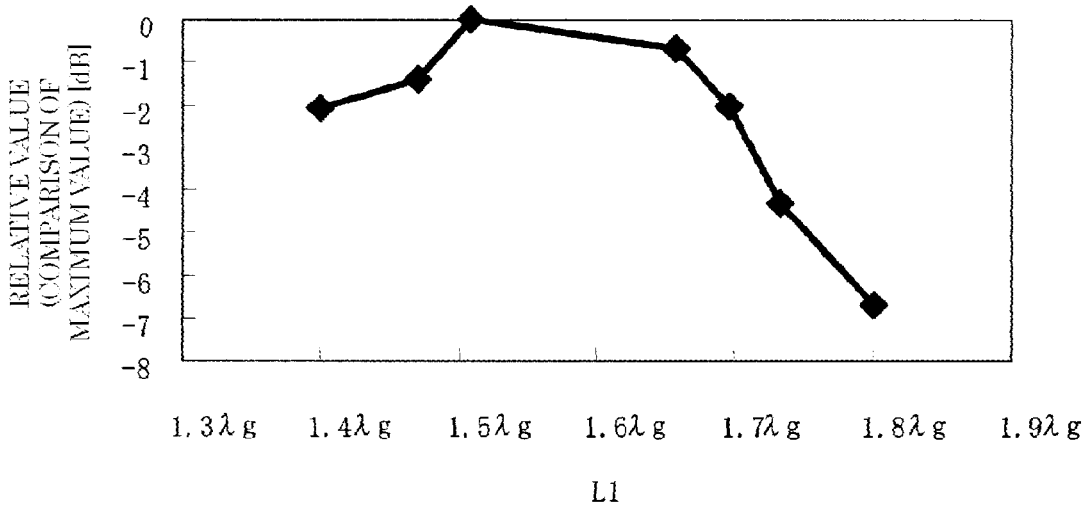
FIG. 6 is a schematic view illustrating an example of a relationship between a length L1 and gain (standardized by the maximum value) according to an embodiment.

FIG. 5 is a schematic view illustrating an example of a change in a tilting angle when the length L1 of one side of the pattern 104 is changed. FIG. 6 is a schematic view illustrating an example of a change in gain when the length L1 of one side of the pattern 104 is changed. A vertical axis in FIG. 6 indicates a relative value of the gain in such a manner that the gain to be measured is divided by the maximum gain in order to standardize the gain.

Referring to FIG. 5, it can be confirmed that a predetermined tilting angle (for example, 50 degrees to 60 degrees) becomes relatively large in a range where the length L1 is from 1.47 λg to 1.8 λg.

In addition, referring to FIG. 6, in a case of L1=1.51 λg approximately, it can be confirmed that the maximum gain is obtained.

Figure 7:
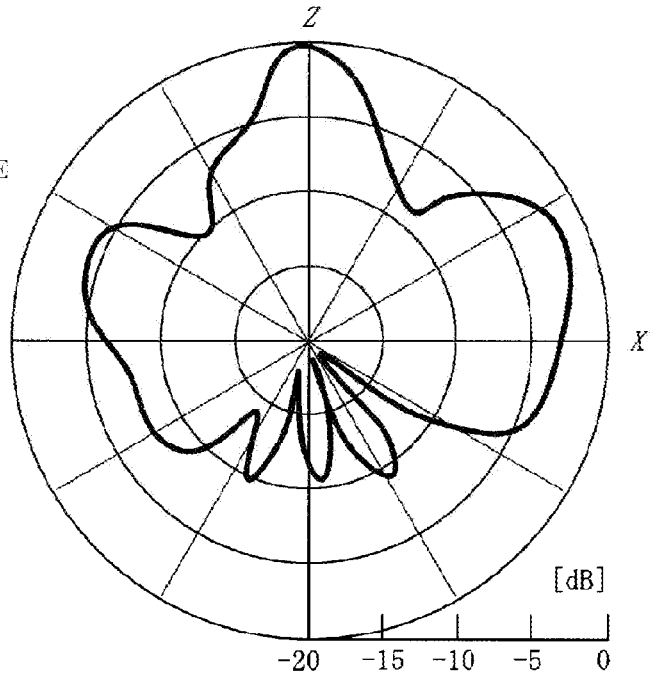
In FIG. 7, (A) is a schematic view illustrating an example of an analysis result (directivity on a vertical (XZ) surface) of an antenna emission pattern in a case of L1=1.40 λg according to an embodiment, and (B) is a schematic view illustrating an example of an analysis result (directivity on a vertical (XZ) surface) of an antenna emission pattern in a case of L1=1.80 λg according to an embodiment.
Figure 7:
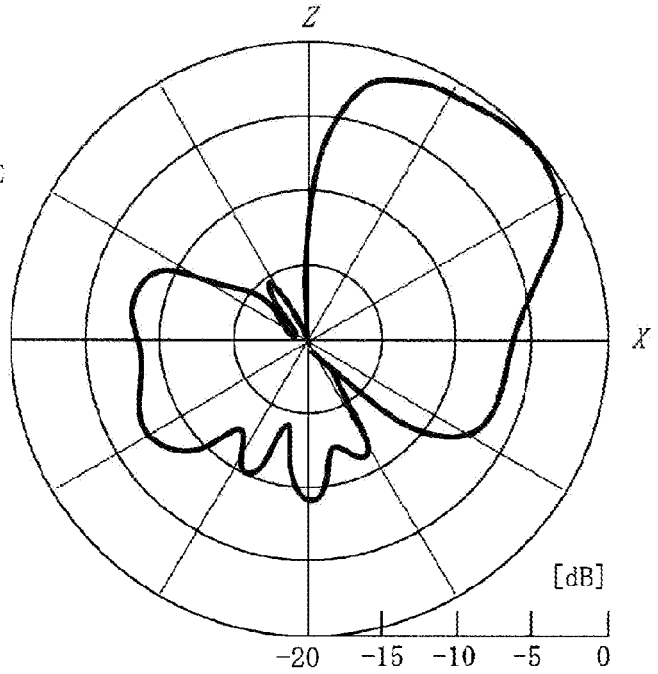

FIG. 7(A) is a schematic view illustrating an example of the emission pattern when the length of one side of the pattern 104 is L1=1.4 λg. FIG. 7(B) is a schematic view illustrating an example of the emission pattern when the length of one side of the pattern 104 is L1=1.8 λg.

Referring to FIG. 7(A), in a case of L1=1.4 λg, it can be confirmed that a direction of the maximum gain is the +Z direction and the directivity is not tilted from the +Z direction. In contrast, referring to FIG. 7(B), in a case of L1=1.8 λg, it can be confirmed that a direction of the maximum gain is tilted from the +Z direction to the +X direction and the directivity is tilted from the +Z direction.

As described above, it is possible to obtain a desired tilting angle with high accuracy by setting the length L1 to be from 1.47 λg to 1.8 λg.

Next, current distribution in the antenna device 110 will be described.

Figure 8:
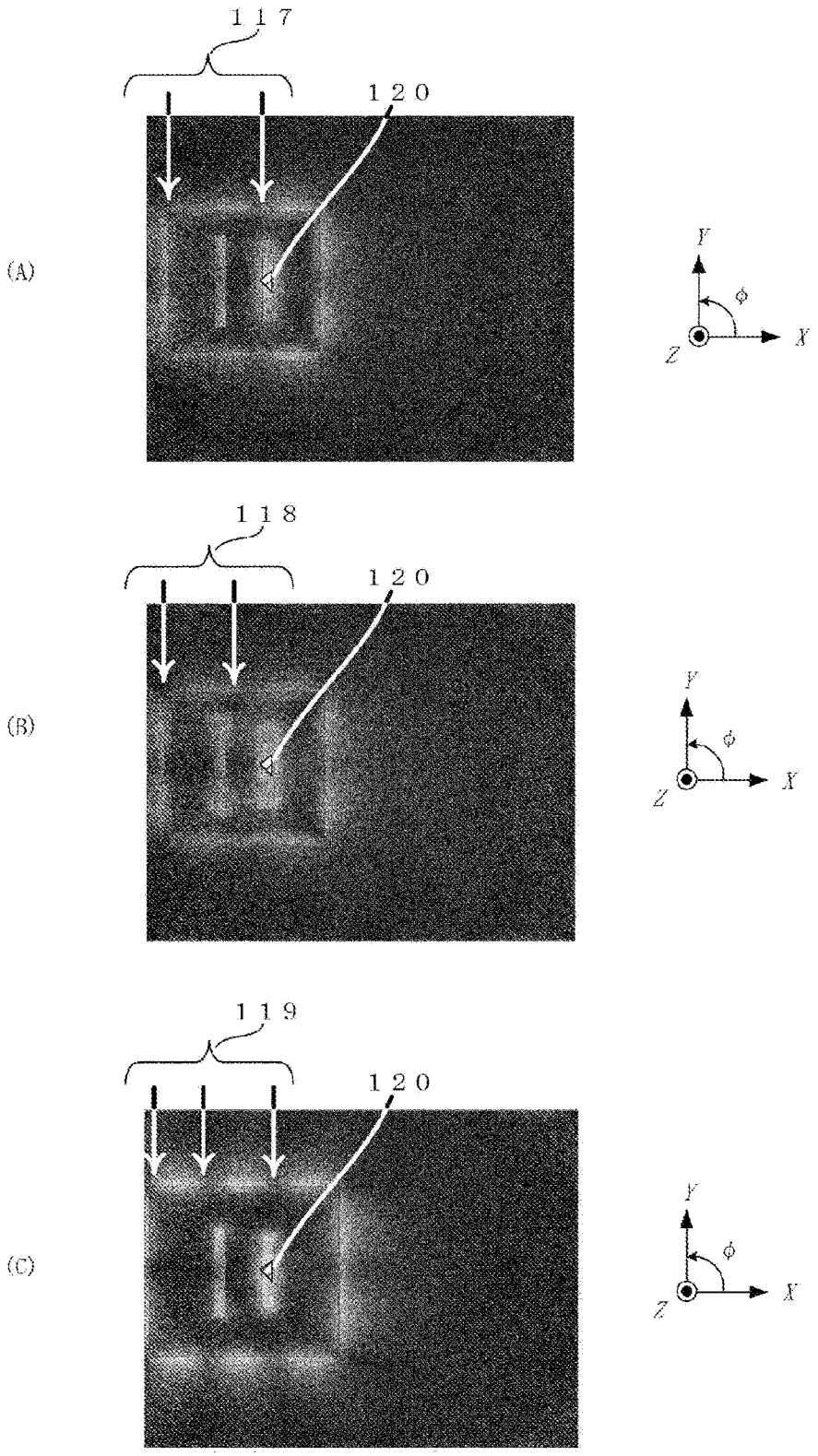
In FIG. 8, (A) is a schematic view illustrating an example of current distribution characteristics (L1=1.40 λg) of an antenna device according to an embodiment, (B) is a schematic view illustrating an example of current distribution characteristics (L1=1.51 λg) of an antenna device according to an embodiment, and (C) is a schematic view illustrating an example of current distribution characteristics (L1=1.80 λg) of an antenna device according to an embodiment.

FIGS. 8(A) to 8(C) are schematic views illustrating an example of the current distribution in the antenna device 110. FIG. 8(A) illustrates an example of current distribution characteristics in a case of L1=1.40 λg. FIG. 8(B) illustrates an example of the current distribution characteristics in a case of L1=1.51 λg. FIG. 8(C) illustrates an example of current distribution characteristics in a case of L1=1.80 λg. FIGS. 8(A) to 8(C) illustrate the current distribution when the electric power is supplied from a power supply point 120. A white portion indicates a relatively large current, and a black portion indicates a relatively small current. The power supply point 120 corresponds to a predetermined point included in the power supply line 107.

Referring to FIGS. 8(A) to 8(C), it can be confirmed that the relatively large current is distributed in the vicinity of a peripheral end portion of the emission element 105, the reflection element 106, and the pattern 104. Accordingly, it can be confirmed that the radio waves emitted from the vicinity of the peripheral end portion of the emission element 105, the reflection element 106, and the pattern 104 are synthesized, thereby forming the emission pattern of the antenna device 110. In addition, when the length L1 of one side of the pattern 104 is changed, positions 117 to 119 of a current node in the vicinity of the peripheral end portion of the pattern 104 are changed. Therefore, for example, as illustrated in FIGS. 7(A) and 7(B), the emission pattern of the antenna device 110 is changed.

Accordingly, it is possible to adjust the tilting angle θ to be a desired angle by adjusting the length L1. For example, assuming a case where the antenna device 110 is mounted on the mobile terminal illustrated in FIG. 15, the desired tilting angle θ is set to be 50 degrees to 60 degrees. In this case, it is possible to obtain the desired tilting angle with high accuracy by setting the length L1 to be from 1.47 λg to 1.8 λg.

Next, an example of a change in the antenna performance when a length dx2 is changed will be described.

Figure 9:
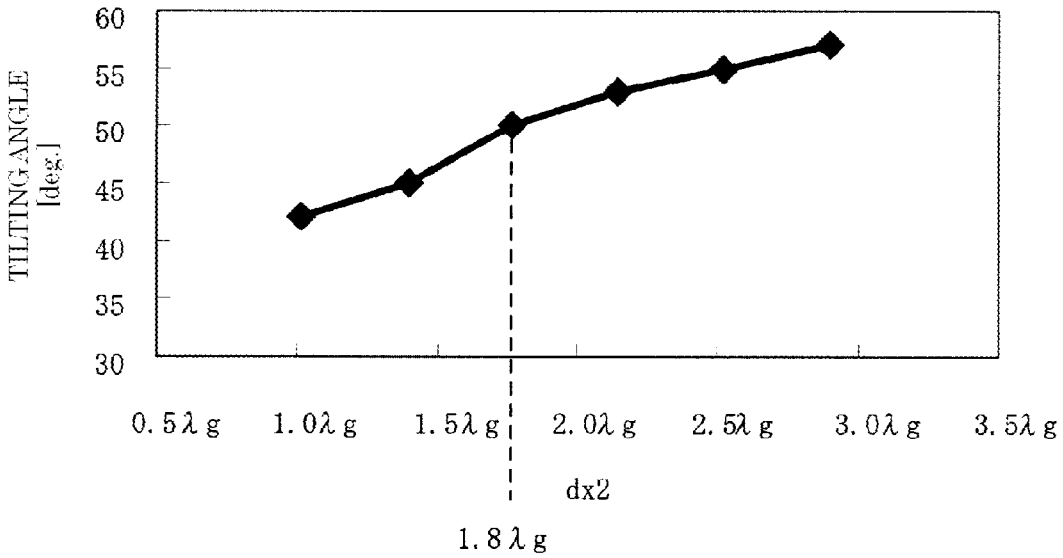
FIG. 9 is a schematic view illustrating an example of a relationship between a length dx2 and a tilting angle θ according to an embodiment.
Figure 10:
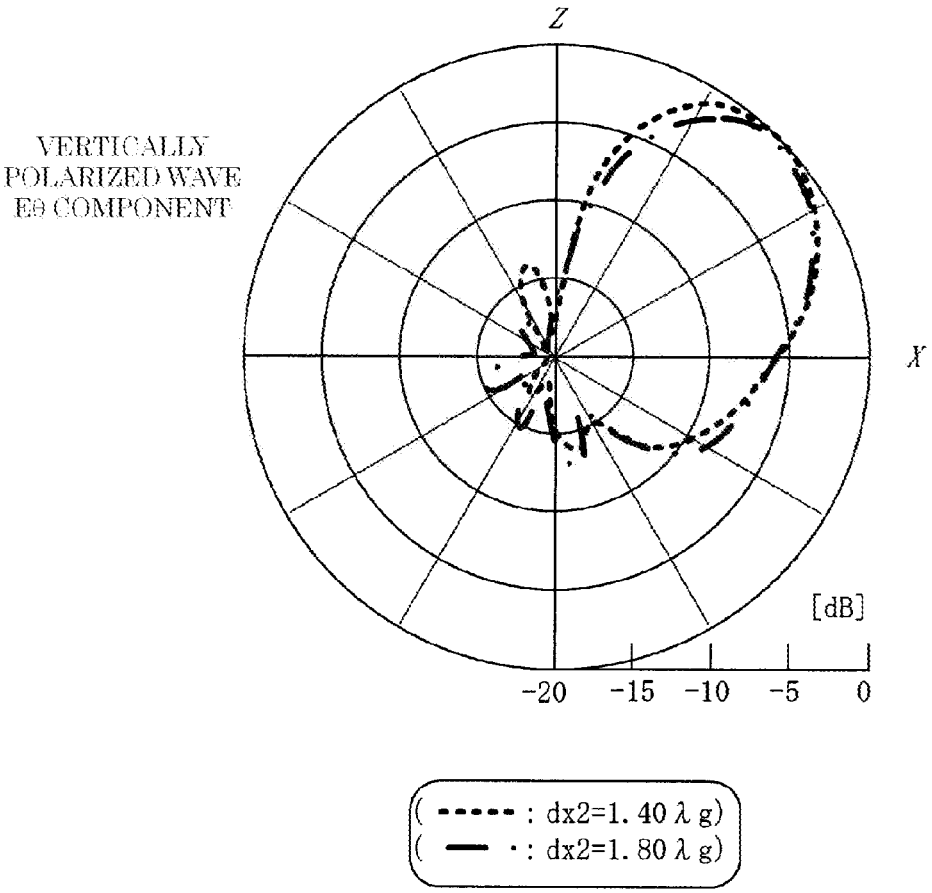
FIG. 10 is a schematic view illustrating an example of an analysis result (directivity on a vertical (XZ) surface) of an antenna emission pattern in a case of dx2=1.40 λg and dx2=1.80 λg according to an embodiment.

FIG. 9 is a schematic view illustrating an example of a relationship between the length dx2 from the emission element 105 to an end side in an emission direction (+X side) in the first dielectric substrate 100 and the tilting angle θ. FIG. 10 is a schematic view illustrating an example of the emission pattern in a case of dx2=1.40 λg and dx2=1.80 λg.

Referring to FIG. 9, it can be confirmed that the tilting angle becomes larger as the length dx2 becomes longer. In addition, the tilting angle becomes 50 degrees or less as the length dx2 becomes smaller than 1.8 λg.

Referring to FIG. 10, it can be confirmed that the directivity of the antenna is further tilted from the +Z direction to the +X direction when the length dx2 is 1.80λg as compared when the length dx2 is 1.40 λg.

As described above, it is possible to adjust the tilting angle θ by adjusting the length dx2. For example, assuming a case where the antenna device 110 is mounted on the mobile terminal illustrated in FIG. 15, the desired tilting angle θ is set to be 50 degrees to 60 degrees. In this case, it is possible to obtain the desired tilting angle with high accuracy by setting the length dx2 to be 1.8 λg or more.

Next, an example of a change in the antenna performance when a length dx1 is changed will be described.

Figure 11:
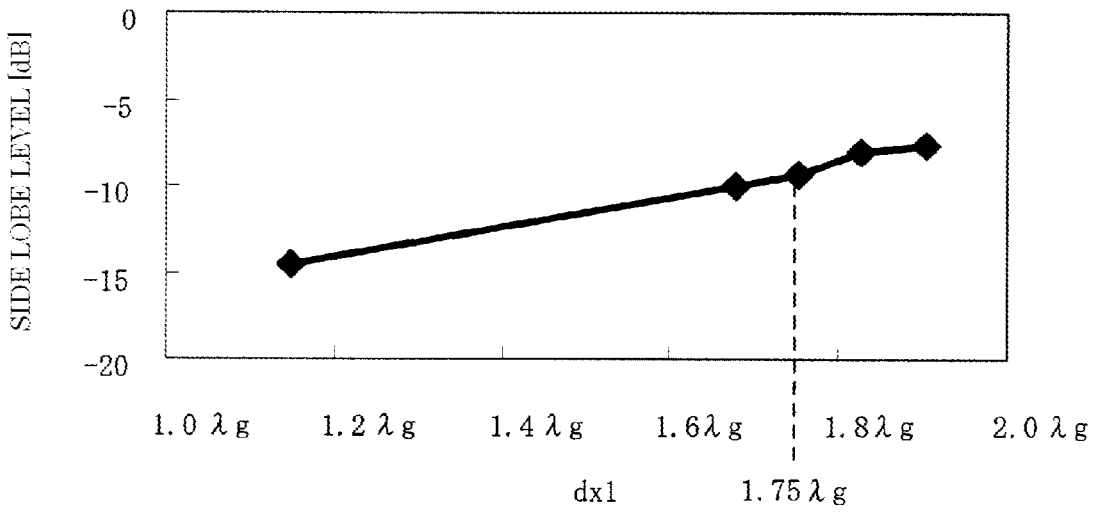
FIG. 11 is a schematic view illustrating an example of a relationship between a length dx1 and a side lobe level according to an embodiment.
Figure 12:
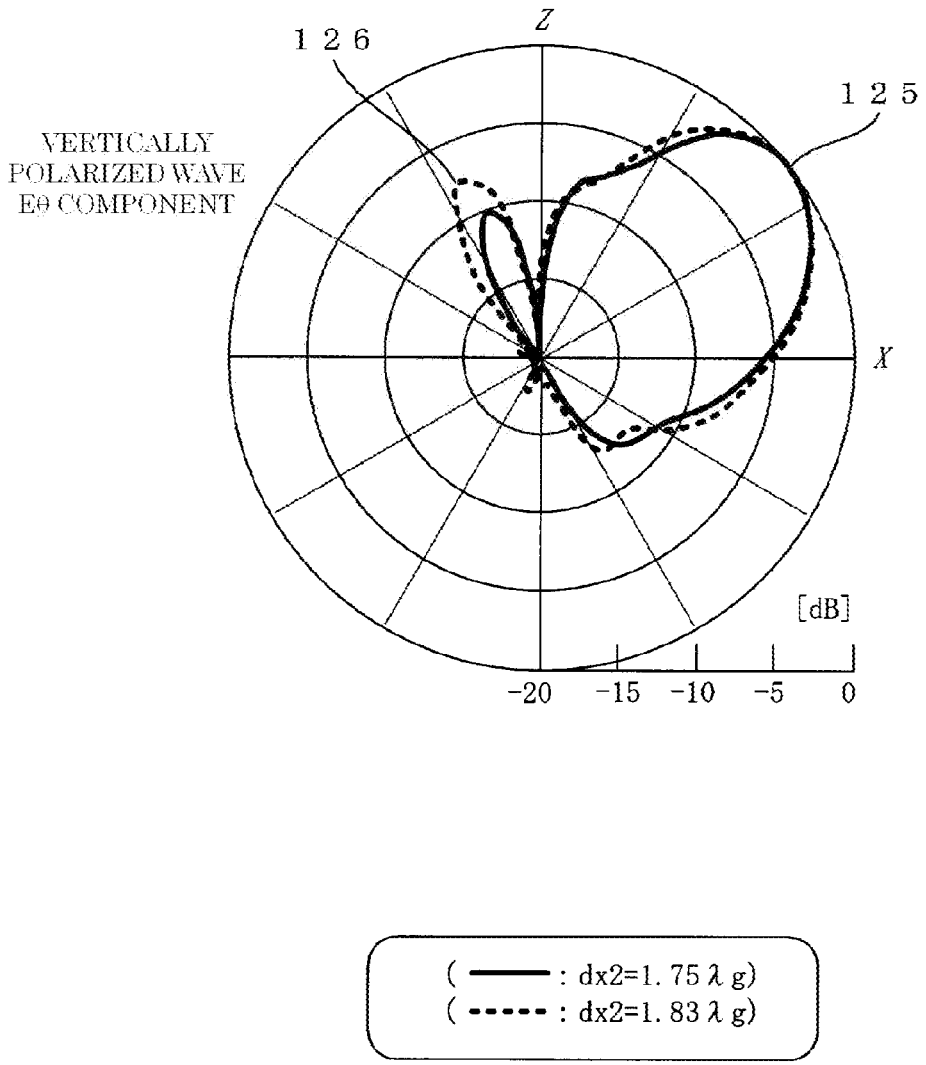
FIG. 12 is a schematic view illustrating an example of an analysis result (directivity on a vertical (XZ) surface) of an antenna emission pattern in a case of dx1=1.75 λg and dx1=1.83 λg according to an embodiment.

FIG. 11 is a schematic view illustrating an example of a relationship between the length dx1 from the emission element 105 to an end side on the reflection element 106 side (−X side) in the first dielectric substrate 100 and a side lobe level. FIG. 12 is a schematic view illustrating an example of the emission pattern in a case of dx1=1.75 λg and dx1=1.83 λg.

Here, a main lobe indicates an emission component of the radio wave in a direction having the strongest directivity. A side lobe indicates an emission component of the radio wave in a direction with the second strongest directivity or the subsequent strongest directivity.

In FIG. 11, a difference between a main lobe level (emission level of the main lobe) and the side lobe level (emission level of the side lobe) is illustrated in decibels (dB). In FIG. 12, the main lobe is illustrated by a reference numeral 125, and the side lobe is illustrated by a reference numeral 126.

Referring to FIG. 11, it can be confirmed that the side lobe level 126 becomes larger as the length dx1 becomes longer. When the length dx1 is 1.75 λg or less, the side lobe level becomes approximately −10 dB. The gain in a direction of the main lobe 125 increases as the side lobe level in FIG. 11 becomes small.

FIG. 12 illustrates the emission pattern in a case of the length dx2=1.75 λg and the length dx2=1.83 λg. Referring to FIG. 12, it can be confirmed that as compared to a case of the length dx2=1.83 λg, the side lobe is suppressed in a case of dx2=1.75 λg.

As described above, it is possible to adjust the side lobe level by adjusting the length dx1.

According to the antenna device 110, it is possible to suitably tilt the directivity of the antenna. In addition, for example, it is possible to realize a beam tilt (for example, the tilting angle of 50 degrees to 60 degrees) which is closer to the substrate horizontal direction (XY direction) than the substrate vertical direction (Z direction).

In addition, the electric power is supplied to the emission element 105 by electromagnetic coupling, thereby enabling the power supply line 107 to be shortened. Accordingly, it is possible to reduce a transmission loss in the power supply line 107, and thus, it is possible to improve the antenna performance. Furthermore, high frequency communication is likely to be influenced by the length of the conductor line. Accordingly, it is possible to realize the high frequency communication having little loss by applying the antenna device 110 to millimeter wave communication.

Figure 14:
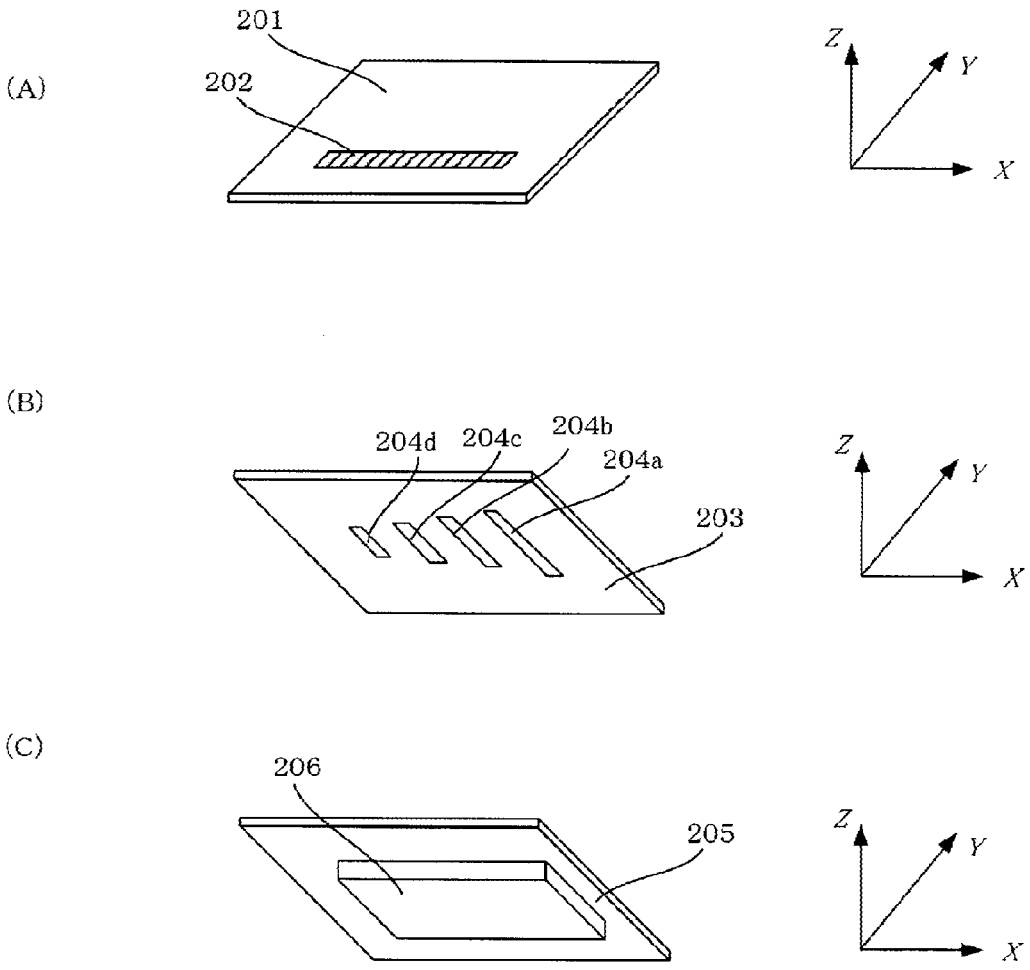
In FIG. 14, (A) to (C) are perspective views illustrating a dielectric substrate, a conductive layer, and a reflection plate in a slot antenna in the related art.

In addition, the ground conductor 103 functioning as a reflection plate can be disposed inside the multilayer substrate in order to prevent the radio wave from being emitted in the −Z direction. Accordingly, it is not necessary to dispose a reflection plate 205 (refer to FIG. 14(C)) as a separate member in addition to the dielectric substrate. Thus, it is possible to simplify the configuration of the antenna device 110.

In addition, the ground conductor 103 functioning as a ground is arranged between the antenna and the electronic component by mounting the electronic component (for example, a chip component and an integrated circuit (IC)) on the L4 layer. This can suppress electrical interference between the antenna and the electronic component. Accordingly, it is possible to easily modularize the antenna device 110 by excellently maintaining electrical properties thereof.

In addition, the antenna device 110 may be mounted on a receiver side, instead of a transmitter side.

The present disclosure is not limited to the configuration of the above-described embodiment, and can also be applied to any configuration if it is possible to achieve the function disclosed in the scope of claims or the function included in the configuration of the present embodiment.

For example, in the above-described embodiment, the configuration has been described in which the emission element 105 and the reflection element 106 are formed in the pattern 104. However, a waveguide element may be further formed therein. The waveguide element is an example of a third slot element.

Similar to the emission element 105 and the reflection element 106, the waveguide element is formed by being cut out from the pattern 104 into a slot shape. In addition, the waveguide element is arranged to be substantially parallel to the emission element 105, on a side (+X side in FIG. 1) opposite to the side of the reflection element 106 from the emission element 105, by leaving a predetermined distance (for example, approximately ¼ λg) from the emission element 105. In addition, an electrical length of the waveguide element is formed to be shorter than an electrical length of the emission element 105. In addition, two or more of the reflection elements 106 and the waveguide elements may be formed.

It is possible to further improve the directivity in the substrate horizontal direction (XY plane) by providing the waveguide element.

Figure 16:
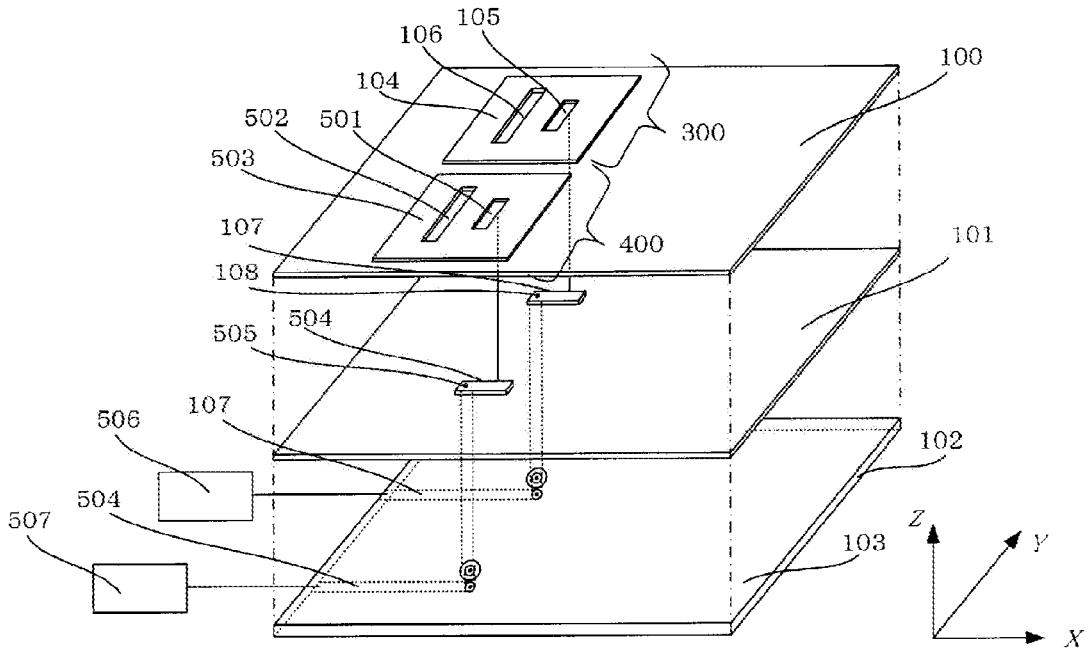
FIG. 16 is an exploded perspective view illustrating a structure example of an antenna device applied to a communication use according to an embodiment.

FIG. 16 illustrates a configuration example when the antenna device according to the present embodiment is applied to communication use (including transmission and receiving). In FIG. 16, the same reference numerals are given to portions configured to have members which are the same as those in FIG. 1. A transmission slot antenna 300 and a reception slot antenna 400 are arranged in the first dielectric substrate 100.

The transmission slot antenna 300 includes the pattern 104 in which the emission element 105 and the reflection element 106 are disposed. The reception slot antenna 400 includes a pattern 503 in which an emission element 501 and a reflection element 502 are disposed. The configuration of the reception slot antenna 400 is the same as the configuration of the transmission slot antenna 300.

The transmission slot antenna 300 is connected to a transmitter 506 via the power supply line 107. The reception slot antenna 400 is connected to a receiver 507 via a power supply line 504.

In FIG. 16, an example has been described in which the transmission slot antenna 300 and the reception slot antenna 400 have the same shape.

However, it is not necessary to form these in the same shape.

Summary of Aspects of the Present Disclosure

An antenna device according to a first aspect of the present disclosure includes:

a dielectric substrate;

a conductive plate which is arranged on one surface of the dielectric substrate;

a first slot element to which electric power is supplied from a power supply line, wherein the first slot element has an electrical length having an approximately ½ wavelength of use frequency, and is formed in the conductive plate;

a second slot element which has an electrical length longer than that of the first slot element, and which is formed in the conductive plate to be substantially parallel to the first slot element by leaving a gap of an approximately ¼ wavelength of the electrical length from the first slot element; and a ground conductor which is arranged to be substantially parallel to the conductive plate by leaving a predetermined gap from the conductive plate.

An antenna device according to a second aspect of the present disclosure is the antenna device according to the first aspect further including:

the power supply line, wherein the power supply line is arranged between the first slot element and the ground conductor, and supplies the electric power by electromagnetic coupling to the first slot element.

An antenna device according to a third aspect of the present disclosure is the antenna device according to the first or second aspect, wherein a third slot element which has an electrical length shorter than that of the first slot element, and which is formed in the conductive plate to be substantially parallel to the first slot element, by leaving a predetermined gap from the first slot element on a side opposite to the second slot element side.

An antenna device according to a fourth aspect of the present disclosure is the antenna device according to any one of the first to third aspects, wherein the dielectric substrate is a multilayer substrate, the conductive plate is arranged on one surface of a first dielectric substrate, the ground conductor is arranged on one surface of a second dielectric substrate arranged on the other surface side of the first dielectric substrate, and an electronic component is mounted on the other surface of the second dielectric substrate.

An antenna device according to a fifth aspect of the present disclosure is the antenna device according to any one of the first to fourth aspects, wherein a length of a side of the conductive plate has an electrical length having a 1.47 wavelength to a 1.8 wavelength of the use frequency of the antenna device.

An antenna device according to a sixth aspect of the present disclosure is the antenna device according to any one of the first to fourth aspects, wherein the first slot element is arranged by leaving a space of an electrical length having a 1.8 wavelength or more of the use frequency of the antenna device from an end portion of the ground conductor closer to the first slot element than to the second slot element.

An antenna device according to a seventh aspect of the present disclosure is the antenna device according to the first or second aspect, wherein the second slot element is arranged by leaving a space of an electrical length having a 1.75 wavelength or less of the use frequency of the antenna device from an end portion of the ground conductor closer to the second slot element than to the first slot element.

The present application is based on Japanese patent application No. 2012-289071 filed on Dec. 28, 2012, the contents of which are incorporated herein by reference.

INDUSTRIAL APPLICABILITY

The present disclosure is advantageously applied to an antenna device which can tilt directivity of an antenna from a horizontal direction of a substrate.

REFERENCE SIGNS LIST

100: first dielectric substrate
101: second dielectric substrate
102: third dielectric substrate
103: ground conductor
104: pattern
105: emission element
106: reflection element
107: power supply line
108: through-hole
109: power supply section
110: antenna device
117, 118, 119: position of current node
120: power supply point
300: transmission slot antenna
400: reception slot antenna
501: emission element
502: reflection element
503: pattern
504: power supply line
505: through-hole
506: transmitter
507: receiver

What is claimed is:

1. An antenna device comprising:

a dielectric substrate;

a conductive plate which is arranged on one surface of the dielectric substrate;

a first slot element to which electric power is supplied from a power supply line, wherein the first slot element has an electrical length of approximately ½ wavelength of a use frequency of the antenna device, and is formed in the conductive plate;

a second slot element which has an electrical length longer than that of the first slot element, and which is formed in the conductive plate to be substantially parallel to the first slot element by leaving a gap of an electrical length of approximately ¼ wavelength of the use frequency of the antenna device from the first slot element; and a ground conductor which is arranged to be substantially parallel to the conductive plate by leaving a predetermined gap from the conductive plate, wherein a length of a side of the conductive plate has an electrical length of 1.47 wavelengths to 1.8 wavelengths of the use frequency of the antenna device.

2. The antenna device according to claim 1, further comprising:

the power supply line, wherein the power supply line is arranged between the first slot element and the ground conductor, and supplies the electric power by electromagnetic coupling to the first slot element.

3. The antenna device according to claim 1, further comprising:

a third slot element which has an electrical length shorter than that of the first slot element, and which is formed in the conductive plate to be substantially parallel to the first slot element, by leaving a predetermined gap from the first slot element on a side opposite to the second slot element side.

4. The antenna device according to claim 1, wherein the dielectric substrate is a multilayer substrate, the conductive plate is arranged on one surface of a first dielectric substrate, the ground conductor is arranged on one surface of a second dielectric substrate arranged on the other surface side of the first dielectric substrate, and an electronic component is mounted on the other surface of the second dielectric substrate.

5. An antenna device comprising:

a dielectric substrate;

a conductive plate which is arranged on one surface of the dielectric substrate;

a first slot element to which electric power is supplied from a power supply line, wherein the first slot element has an electrical length of approximately ½ wavelength of a use frequency of the antenna device, and is formed in the conductive plate;

a second slot element which has an electrical length longer than that of the first slot element, and which is formed in the conductive plate to be substantially parallel to the first slot element by leaving a gap of an electrical length of approximately ¼ wavelength of the use frequency of the antenna device from the first slot element; and a ground conductor which is arranged to be substantially parallel to the conductive plate by leaving a predetermined gap from the conductive plate, wherein the first slot element is arranged by leaving a space of an electrical length of 1.8 wavelengths or more of the use frequency of the antenna device from an end portion of the ground conductor closer to the first slot element than to the second slot element.

6. The antenna device according to claim 5, further comprising:

the power supply line, wherein the power supply line is arranged between the first slot element and the ground conductor, and supplies the electric power by electromagnetic coupling to the first slot element.

7. The antenna device according to claim 5, further comprising:

a third slot element which has an electrical length shorter than that of the first slot element, and which is formed in the conductive plate to be substantially parallel to the first slot element, by leaving a predetermined gap from the first slot element on a side opposite to the second slot element side.

8. The antenna device according to claim 5, wherein the dielectric substrate is a multilayer substrate, the conductive plate is arranged on one surface of a first dielectric substrate, the ground conductor is arranged on one surface of a second dielectric substrate arranged on the other surface side of the first dielectric substrate, and an electronic component is mounted on the other surface of the second dielectric substrate.

9. An antenna device comprising:

a dielectric substrate;

a conductive plate which is arranged on one surface of the dielectric substrate;

a first slot element to which electric power is supplied from a power supply line, wherein the first slot element has an electrical length of approximately ½ wavelength of a use frequency of the antenna device, and is formed in the conductive plate;

a second slot element which has an electrical length longer than that of the first slot element, and which is formed in the conductive plate to be substantially parallel to the first slot element by leaving a gap of an electrical length of approximately ¼ wavelength of the use frequency of the antenna device from the first slot element; and a ground conductor which is arranged to be substantially parallel to the conductive plate by leaving a predetermined gap from the conductive plate, wherein the second slot element is arranged by leaving a space of an electrical length of 1.75 wavelengths or less of the use frequency of the antenna device from an end portion of the ground conductor closer to the second slot element than to the first slot element.

10. The antenna device according to claim 9, further comprising:

the power supply line, wherein the power supply line is arranged between the first slot element and the ground conductor, and supplies the electric power by electromagnetic coupling to the first slot element.

11. The antenna device according to claim 9, further comprising:

a third slot element which has an electrical length shorter than that of the first slot element, and which is formed in the conductive plate to be substantially parallel to the first slot element, by leaving a predetermined gap from the first slot element on a side opposite to the second slot element side.

12. The antenna device according to claim 9, wherein the dielectric substrate is a multilayer substrate, the conductive plate is arranged on one surface of a first dielectric substrate, the ground conductor is arranged on one surface of a second dielectric substrate arranged on the other surface side of the first dielectric substrate, and an electronic component is mounted on the other surface of the second dielectric substrate.

* * * * *